United States Patent [19]

Güell

[11] Patent Number: 4,860,557

[45] Date of Patent: Aug. 29, 1989

[54] NEEDLE SELECTION SYSTEM FOR A CIRCULAR KNITTING MACHINE

[75] Inventor: José M. D. Güell, Barcelona, Spain

[73] Assignee: Jumberca, S.A., Barcelona, Spain

[21] Appl. No.: 162,085

[22] Filed: Feb. 29, 1988

[30] Foreign Application Priority Data

Mar. 17, 1987 [ES] Spain ..... 8700741

[51] Int. Cl.[4] ..... D04B 9/10; D04B 15/78

[52] U.S. Cl. ..... 66/14; 66/219; 66/225

[58] Field of Search ..... 66/14, 219, 222, 225

[56] References Cited

U.S. PATENT DOCUMENTS 3,063,269 11/1962 Losert et al. ..... 66/14
3,916,646 11/1975 Takigawa et al. ..... 66/219
4,036,033 7/1977 Jesson ..... 66/225 X
4,138,865 2/1979 Lüth ..... 66/219
4,718,254 1/1988 Lonati ..... 66/14

FOREIGN PATENT DOCUMENTS 138696 4/1985 European Pat. Off. ..... 66/222
1413533 11/1975 United Kingdom ..... 66/219

*Primary Examiner*—Wm. Carter Reynolds
*Attorney, Agent, or Firm*—Staas & Halsey

[57] ABSTRACT

The selection system is based on a reciprocal action of a selector jack for each needle and operative cams, such that each selector jack may not be selected or may be selected one or two times during its engagement with one same operative cam, owing to the existence of two electronic controls for each cam. Each control includes a box having a plurality of selectors for the jacks, and the selectors may be moved from a retracted inoperative position to an extended activated position for a very short period of time due to a special arrangement of magnets.

10 Claims, 10 Drawing Sheets

FIG. 4
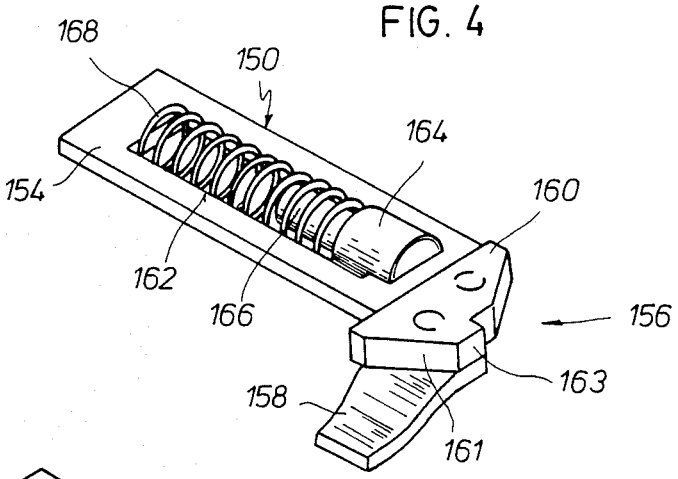
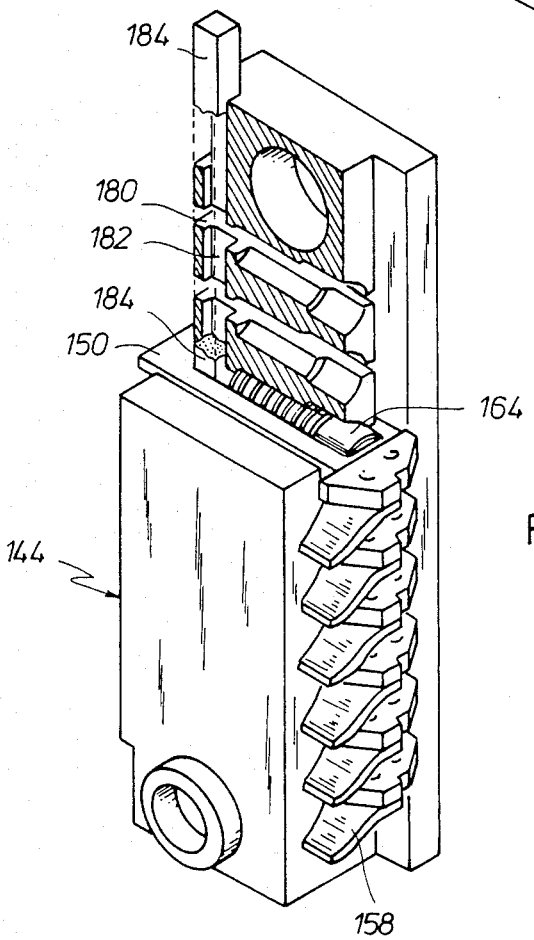
FIG. 5

NEEDLE SELECTION SYSTEM FOR A CIRCULAR KNITTING MACHINE

BACKGROUND OF THE INVENTION

The invention relates to a needle selection system for a circular knitting machine having, on the one hand, static, i.e., non-rotating members comprising for each needle:

a selector jack capable of a rocking movement and of a vertical movement and having an alignment butt, a selector butt and a rocking cancellation butt;

an intermediate jack having a butt and capable of rocking integrally with the selector jack and capable of a vertical movement independent of the vertical movement of the selector jack; and a slider having also a butt and associated with the needle but not associated with the rocking movement of the jacks, while being capable of accompanying the intermediate jack in the upward movements thereof; and having, on the other hand, rotary members comprising in turn:

operative cams;

rocking cancellation cams;

electronic multilevel jacquard controls, each of which comprises: an alignment cam and a plurality of selectors, located at different levels, each of which is capable of occupying a retracted position in which it does not engage the selector butts and an extended position in which there is mutual engagement between a selector and a butt, the corresponding jack being caused to rise and the selector being moved to said retracted position.

It is an increasing requirement in the circular knitting machines of the type described to have the capacity of a large number of operative sets, i.e., feeds, thereby improving the machine performance. Each operative set is also required to provide a wide range of needle selections, each leading to a different needle position, making the machine more versatile. It is also very important for the machine to be able to run at high speeds, since there is obviously a direct relationship between the speed and the machine output. It should be recalled here that the machine speed depends on the speed of reaction of the electromagnetic means used in the needle selection.

These objectives, listed inexhaustively, are attained according to the invention by means of a selection system of the type described, wherein said selector jack and said operative cams are provided with complementary means which, when one selector jack is caused to rise, mutually engage and cause selection of the jack by rocking it; wherein one operative cam comprises a first main track adapted to receive the butt of the intermediate jack and a second main track along which there moves the butt of the slider, said second track being provided with an interrupted lower horizontal portion over which said slider butt travels when the slider has not been previously raised by a vertical upward movement of the intermediate jack, there being two electronic controls for each operative cam, such that each selector jack is capable of not being selected or of being selected one or two times during its engagement with one same operative cam.

Preferably according to the invention, the said complementary means comprise, on the one hand, an upper shoulder of the jack and, on the other hand, lower sloping surfaces of the operative cam.

Alternatively according to the invention, the following may happen:

if while engaged with one same operative cam, the selector jack is selected twice, the needle remains in the inoperative position; if while engaged with one same operative cam the selector jack is selected the first time and is not selected the second time, the needle is raised to the tuck position; if during such engagement the selector jack is not selected the first time and is selected the second time, the needle is raised to the operative fabric face knit position; finally if during said engagement the selector jack is not selected at all, the needle is raised to the position of needle transfer from lower cylinder to the upper cylinder.

Each electronic multilevel jacquard control may comprise a box in which there is housed generally horizontally a plurality of selectors which may slide between a retracted position and an extended position and in which each selector comprises a sheet-like member having: a head; a rear end; a slot; means housed therein urging the selector to said extended position; means for constraining said sliding movement to said extended position.

Bearing the above in mind, in a further development of the invention said head comprises: a downwardly directed portion having on the upper side thereof a surface generally having the form of an inclined plane adapted to engage the selector jack butt, thereby causing it to rise; and a prismatic cam having a generally flat vertical operative surface, adapted to be engaged by the butt of the upwardly raised selector jack, said engagement causing the selector to move from said extended position to said retracted position.

Preferably also according to the invention, said sliding movement constraining means comprise a vertical key member crossing through a rear portion of the slot of each selector.

It is known to have each box associated with an electronic and electromagnetic unit adapted selectively to retain the selectors in the retracted position thereof.

According to a further feature of the invention, each unit comprises: a single central core having central pole extensions, each of the latter being opposite the rear end of a selector; an electromagnetic coil surrounding each central pole extension; a pair of flat ceramic permanent magnets situated one on each side of the central core and in contact therewith; a pair of lateral pole extensions, each one contacting one of the permanent magnets on the opposite side thereof to the central core, said lateral pole extensions being closer to the box than the central pole extensions with the distance therebetween being greater than the width of the rear end of a selector, such that when the selector is in the retracted position, said rear end engages the corresponding central pole extension between the said lateral pole extensions, an airgap being formed between each lateral extension and the selector.

BRIEF DESCRIPTION OF THE DRAWINGS

One exemplary embodiment of a preferred form of the invention is described hereinafter with reference to the accompanying drawings, in which:

FIG. 4 is a perspective view of a selector;

FIG. 5 is a perspective view, partly in section, of a box adapted to contain a selector for each level of selection;

DETAILED DESCRIPTION OF THE PREFERRED EMBODIMENTS

Figure 1:
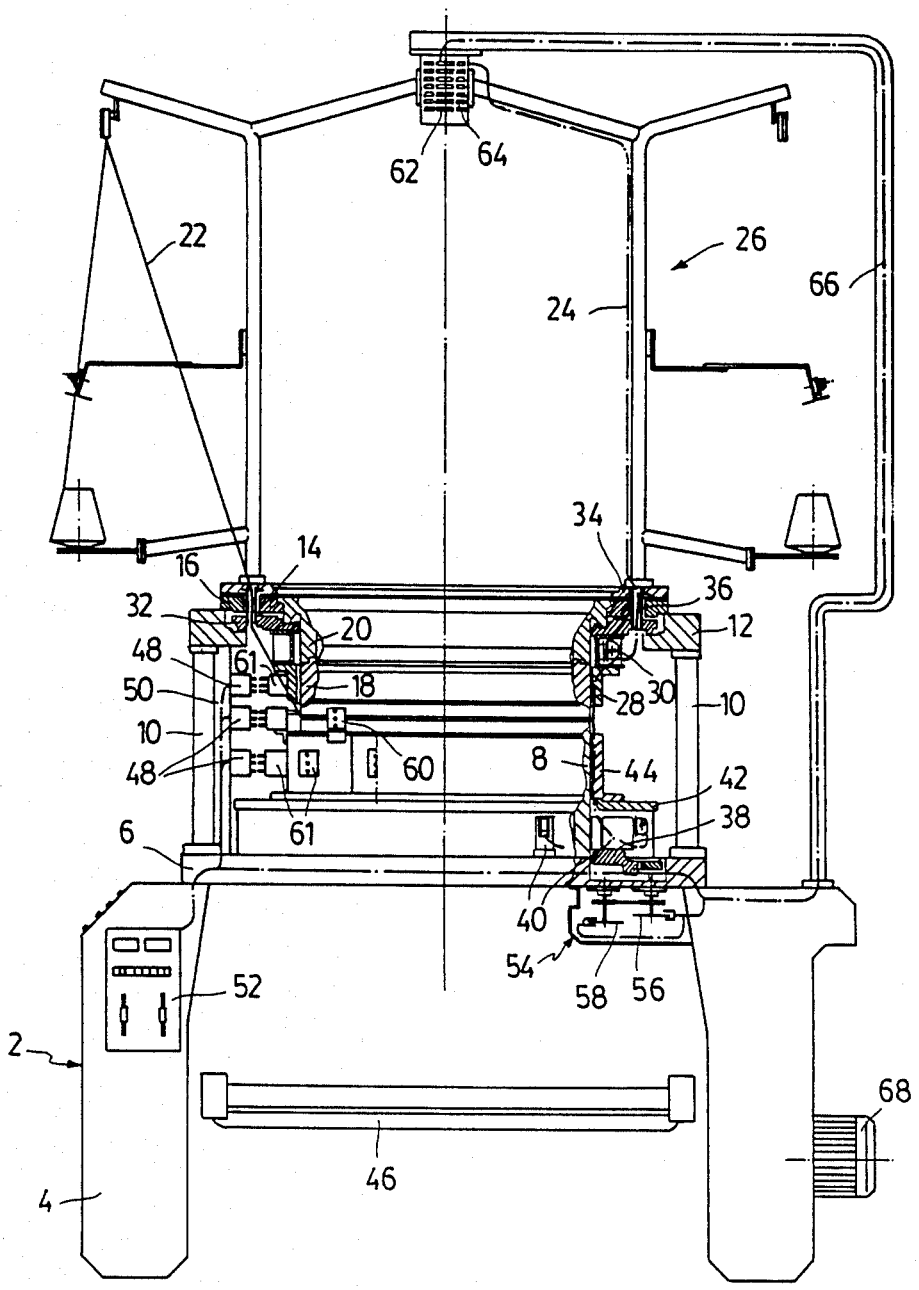
FIG. 1 is a schematic elevation view, partly in cross section, of a circular knitting machine provided with the system according to the invention.

The schematic drawing of the circular knitting machine of FIG. 1 shows a so-called sweater machine or machine for links/links type garment length machine, with roving course and rotary creel (or yarn store). However, the invention is not limited to such links/-links type circular machines, but is applicable to any knitting machine with moving jacquard controls, and stationary striper controls, stitch graduation, etc.

The machine comprises a structure 2 with legs 4 supporting a lower ring 6, on which there bears a lower needle cylinder 8 which, in the illustrated embodiment is stationary. Around the periphery of the lower ring 6 there are supported columns 10 supporting in turn a static ring or tripod ring 12, on which the whole of the weight of the upper portion of the machine, comprising both the rotary and the stationary members, bears.

The upper stationary members are as follows: the inner locking ring 14, the outer locking ring 16, the upper cylinder 18 (in the case of a disc and cylinder sweater machine, the upper cylinder 18 would be replaced by the disc and there would be, furthermore, a center shaft and crown wheel and pinion mechanism to vary the relative height of the disc to the cylinder), and the upper cylinder holder 20.

The inner and outer locking rings 14 and 16 are provided, respectively, as is known in the art, with accurately mating radial slots in which accurately set sliders guaranteeing their relative positions may slide.

In their movement, all the sliders alternately successively come out of the inner locking ring 14 to allow passage of the yarn 22 and the electric lines 24 extending from the overhead rotary creel towards other moving parts located below the tripod ring 12.

The moving members of the upper portion are as follows: the sections of the upper cam body 28, the electronic slave distributor 30 and the upper crown wheel 32. The latter bears on the tripod ring 12 and in turn supports the creel holder ring 34, on which the said yarn creel or store 26 is supported. The electronic distribution 30 recycles, amplifies and distributes signals and may be centralized on the rotary part of the machine or be subdivided into several sub-units incorporated in each moving electronic jacquard selection control 40.

Tubes 36 are located at regular intervals on the upper crown wheel 32, one for each operative group. Yarns 22 and electrical lines 24 pass respectively through these tubes. Tubes 36 pass through the open space between the inner locking ring 14 and the outer locking ring 16 without interference with the said joining sliders, since they are provided with a guide butt running in a track milled around the complete perimeter of the upper crown wheel, separating the slider from the tubes 16 at the right time.

A lower rotary crown wheel 38 is located in the lower portion of the machine on the ring 6 and supports the multilevel electronic jacquard controls 40, the support ring 42 for the lower cam body 44 and the sections of the said cam body 44.

The machine also comprises: a fabric take-up beam 46, a fixed electronic control unit 48, a column 50 for said fixed electronic controls, a non-rotating electronic controller 52, a timer set 54 comprising, on the one hand, a multilevel needle timer 58 for recognizing and reporting the individual position of each needle to the electronic controller 52 depending on the level thereof and, on the other hand, a timer 56 for sequential selection, by machine revolutions, of the upper cylinder 18 portions, of the moving mechanical stripers 60, the stitch graduations, etc.

There are likewise provided moving mechanical controls 61 and on top of the creel 26 there is a group of slip rings 62 and corresponding brushes 64 to transmit the orders of the controller 52 to the moving electronic jacquard controls 40, with the peculiarity that the number of slip rings depends on the number of said controls 40 and is independent of the number of levels of each control, there being a slip ring for each control, one ring for each timing signal, one ring for passage of each independent voltage and, in general, as many pairs of rings as there are independent groups of moving electric and/or electronic signalling, security detection, elements on the machine. In the embodiment described, the slip rings 62 do not rotate and the brushes rotate with the creel 26. The controller 52 is connected to the brush unit by way of an overhead line 66.

Neither the conventional drive system transmitting the drive from the motor 68 to the moving parts nor the shaft transmitting the movement from the lower crown wheel 38 to the upper crown wheel 32 are shown in the drawing figures.

The above described lay-out of the machine allows a single controller 52 located on a static part of the machine, such as a leg 4, to receive machine movement timing signals and control all the fixed and rotary electronic members while the number of brushes transmitting signals or power to the electronic controls 40 is very much smaller than the number of members to be controlled.

From the electronic point of view, the machine comprises the controller 52 which may be programmed directly through a keyboard or by loading a magnetic tape cassette, punched paper tape, diskette or EPROM memory cartridge.

The controller 52 receives two types of timing signals. The first type corresponds to the passage of each needle and is received through as many differentiated channels as there are jacquard selection levels on the machine.

For each machine rotation, the controller 52 receives as many needle timing signals as there are needles in the machine, spread out over the different channels.

The second type of timing signal is received from the fixed controls 48 and the timing sequence is repeated each machine rotation as many times as there are operative sets and arrive at the controller 52 over different channels, one for each fixed control 48 mounted on the column 50.

The outgoing signals from the controller 52 to the multilevel jacquard controls 40, as said above, first go by an overhead line 66 to the slip rings 62 from where, before reaching the members to be controlled, they are fed to the distributor 30 over the electrical lines 24. The signals reaching the distributor 30 over a single channel are recycled, amplified and distributed in as many signals and channels as there are levels at each jacquard control 40.

Figure 2:
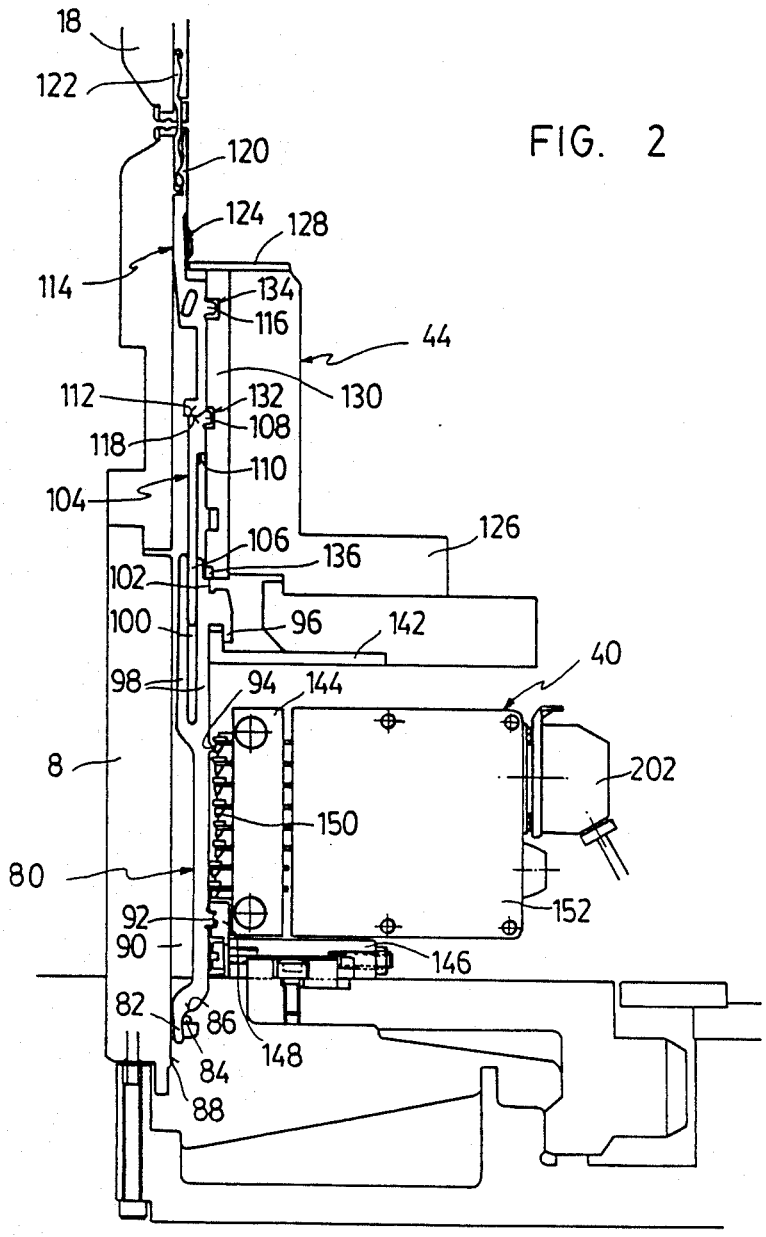
FIG. 2 is an axial section view of the cylinder of the circular machine, showing the particular arrangement of the selection system thereof.

Referring to FIG. 2, the machine is provided with a double multilevel moving electronic selection on the needle cylinder 8, with five technical ways in each set (operative, inoperative, tuck, needle transfer to upper cylinder 18 and needle transfer pick-up from the upper cylinder 18), all without moving portions or interchangeable cams. In the interior of the lower needle cylinder 8 there is a flat, elongated selector jack 80 having a curved lower extension 82 which cooperates with a spring 84 to urge the jack radially towards the interior of the cylinder 8. The spring 84 bears against the outer concave surface of the extension 82 and also acts as a drawdown limiter for the jack by way of its engagement with a generally horizontal jack surface 86 situated at the upper portion of the portion containing the outer concave surface. The selector jack 80 bears against the bottom 88 of the cylinder track 90 by way of an inner convex surface, generally opposite the outer concave surface and which acts as a rocking surface.

The selector jack 80 is also provided with a vertical alignment butt 92, helping to locate the jack in the neutral position after each selection, a selection butt 94 adapted to be situated at a level selected from a plurality of preset levels, corresponding to the aforesaid neutral position, a vertical, inverted rocking cancellation butt 96 located at the top end of the jack, a fork between the arms 98 of which there is defined a longitudinal space 100 and an upper shoulder 102. The relationship of these members with other parts of the machine is described below. Each set of jacks contains as many jacks as selection levels and each jack of a set is provided preferably with the corresponding selection butt at a level immediately below that of the preceeding jack.

Above the selector jack 80 there is the intermediate jack 104, the lower portion 106 of which slides within the longitudinal space 100. Intermediate jack 104 is provided with a butt 108, a horizontal surface 110 adapted to abut the upper end of one arm 98 to limit the lowermost position of the intermediate jack 104 relative to the selector jack 80 and an upper flat surface 112.

The insertion of the lower portion 106 of the intermediate jack 104 within the longitudinal space 100 of the jack 80 means that the intermediate jack 104 rocks with the selector jack 80.

Above the intermediate jack 104 there is a slider 114, having a butt 116, a lower surface 118 engaging the surface 112 and an upper extension 120 conventionally associated with a needle 122 to guide it to the inoperative, tuck, operative and transfer and transfer pick-up positions. Said needle 122 is a conventional two-headed needle.

A retaining strap 124 engages the slider 114 to prevent the needle 122 from becoming disengaged from the slider 114 in the operative stages and allows rocking of the slider and release of the needle in the transfer stages.

A plurality of rotary members, described hereinafter, is associated with the cylinder 8:

The lower cam body 44 which in turn comprises: a preferably cast support 126, a press 128 to prevent the ingress of fly and the like, a plurality of operative cams or cam sections 130, each having a first main track 132 and a second main track 134 (which in turn branch, as explained hereinafter) adapted respectively to guide the butt 108 of the intermediate jack 104 and the butt 116 of the slider 114. Said cam is also provided with two sloping surfaces 136 (FIGS. 2 and 3) which engage the corresponding upper shoulder 102 of the selector jack 80 and are situated at the lower portion of the cam 130, where there are also to be found open spaces 138 (Figure 3) to allow the passage of said upper shoulder 102 in the inoperative areas. Each operative cam 130 has associated therewith a moving stitch cam 140 (FIG. 3) to graduate the stitch length. The cam tracks 132 and 134 and the branches thereof are seen to cause vertical movements of the jacks and slider, while the sloping surfaces 136 cause them to rock;

A cancellation cam 142 which engages the cancellation butt 96 of the jack 80 and indirectly the corresponding box 144, and is associated with a corresponding multilevel electronic jacquard control 40.

Each operative cam 130 is associated with two controls 40, one of which is provided with a base 146 supporting the remaining members which are: an alignment cam 148 adapted to engage the vertical alignment butt 92 of the selector jack 80, the box 144, preferably of injection molded nylon, containing a plurality of selectors 150 and an electronic and electromagnetic unit 152.

Each cam section or operative cam 130, together with two controls 40, form an operative set.

Each selector 150 (FIG. 4) is formed generally by a sheet-like member 154, preferably situated horizontally in the box 144 (FIG. 5) and perfectly guided therein, with a very low friction value. Each selector is provided with a head 156, having a drawdown portion having at the upper end thereof a sloping surface 158 (being preferably an extension of the sheet-like member 154) and a prismatic cam 160 having a generally triangular base, with an active surface 161 and a front face 163 and which is mounted above the downwardly directed portion 158. Each selector is provided with a generally rectangular longitudinal slot 162, in which there is a preferably cylindrical piston 164 having an extension 166 in engagement with a compression spring 168 urging the piston against the front edge of the slot 162.

Each box 144 (FIG. 5), as stated above, contains a plurality of selectors 150, each of which is at one of the preset levels corresponding to the selector butts 94. The selectors may slide lengthwise in the corresponding seat 180 and in a passage 182 of the box there is housed a vertical key 184 (shown partly cutaway) crossing through a generally rear portion of the space determined by the slot 162, whereby it constitutes a limiting abutment for the sliding of the selector towards the cylinder 8.

Figure 6:
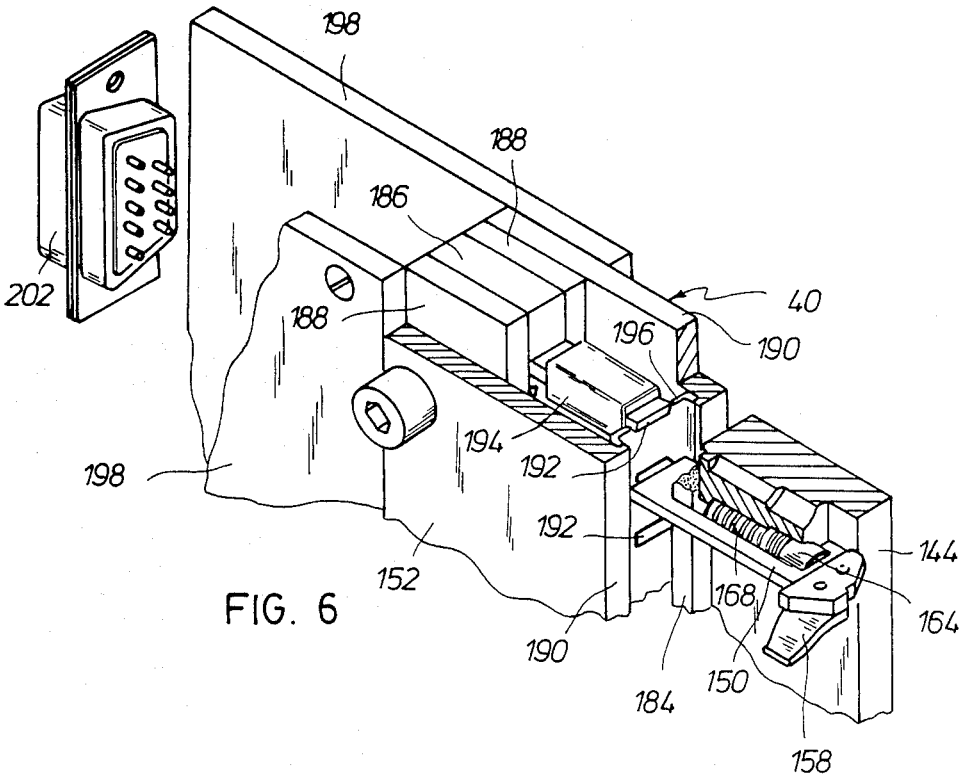
FIG. 6 is a view, partly in perspective and partly in section of a multilevel electronic jacquard control.

Each box (FIG. 6) is associated with an electronic and electromagnetic unit 152 which is formed by a set of central poles formed by a common central core 186, a pair of preferably prismatic flat ceramic permanent magnets 188 being situated one at each side of the central core 186. Outwardly of each magnet 188 there are respective lateral pole extensions 190 which are longer than the central core 186 plus the central pole extensions thereof and which are common to the whole unit. To the common central core 186 there is attached a central pole extension 192 for each selector 150 and each central pole extension 192 is surrounded by an electromagnetic coil 194. The coil set is provided with a front protective member 196 and at the side there are protective walls 198, situated at the side of or behind the lateral pole extensions 190.

The two flat ceramic permanent magnets 188 are abutted by faces of the same polarity (for example, the South face) to the common central core 186 and also by faces of the same polarity (for example, the North faces) they abut the respective lateral pole extensions.

Figure 7:
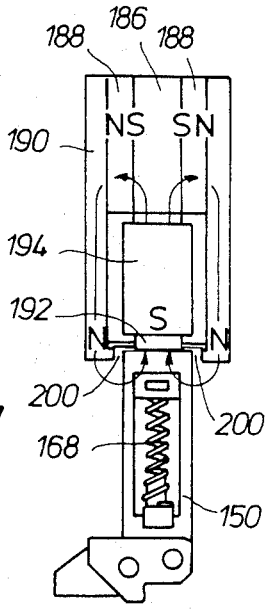
FIGS. 7 and 8 are schematic plan views from above of a selector relative to the electronic and electromagnetic unit, in two different situations.

The magnetic circuit created by each North pole (FIG. 7) is symmetrically closed through the lateral pole extensions 190, flows across respective controlled airgaps 200 and is subdivided into various independent flows through each selector 150. Part of both lateral fluxes converges on each selector, forming a single flux which is closed through each central pole extension 192 on the central core 186 and the South faces of the magnets.

The arrangement as described allows the force required to retain all the selectors 150 independently with a single pair of magnets to be guaranteed. This facilitates the construction of the unit and the small transverse dimensions thereof make it suitable for application to machines having many sets.

Figure 8:
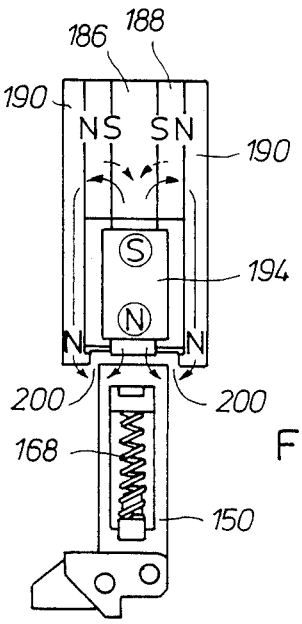

If the coil 194 is energized, it reverses the polarity (FIG. 8), whereby the magnetic field is destroyed or neutralized and the central pole extension 192 ceases to attract the selector 150, whereby the force of the compression spring 168 prevails and the selector 150 is adapted to engage a selector butt 94 of the jack 80.

The response time of the selector 150, defined as the sum of the demagnetization time required to destroy or neutralize the magnetic field and the mechanical response time for the selector 150 to travel over the distance between the retracted retained position and the extended selection position is very short and reliable, due to:

- the existence of the controlled airgap 200 guaranteeing the absence of magnetic remanence and facilitating the destruction of the magnetic field of the magnets;
- the proximity of the coils 194 to the selector 150 making the demagnetization action more effective and faster;
- the low mass of the selector 150 and the center position of the spring 168 cooperating to reduce the mechanical response time.

Incorporated in the electronic and electromagnetic unit 152 and therefore forming part of the multilevel electronic jacquard control 40 there is a distributor recycling unit (not shown, located between the walls 198) for the control signals of the electromagnets or coils 194. The function of this unit is to distribute the signals arriving in serial form through a single line from the brush unit 64 into parallel signals directed through independent lines to each of the coils 194 of the unit.

The fact that the said signal distributor recycling units are incorporated directly on the electronic/electromagnetic units 152 (or alternatively grouped together on an also rotating part of the machine) helps to overcome one of the most important problems with this type of machine.

Up to now it has been impossible to make the following items compatible in a circular knitting machine having static knitting sections and moving operative cams 130 (or cam sections):

- a high number of operative sets;
- five simultaneous technical ways per set;
- high speed;
- a static controller 52, facilitating the programming and maintainance thereof and avoiding faults;
- moving electronic jacquard controls 40 which are more reliable for fine gauges and high speed than one or two level controls;
- a low number of electric lines 24 from the controller 52 to the moving members.

The last named peculiarity simplifies the machine and allows the necessary speed to be maintained, since the joint between the two fixed parts of the machine (the inner and outer locking rings 14 and 16) between which the tubes 36 containing the lines 24 transmitting the signals to the controls 40 from the brush units 64 have to pass is not excessively weakened.

Before explaining the operation of the machine, to facilitate such explanation, details of the operative cam 130 are given below. As mentioned above, said cam 130 comprises a first main cam track 132 for the butt 108 of intermediate jack 104 and a second main cam track 134 for the butt 116 of the slider 114.

The first rack 132, when seen from left to right in FIGS. 9 to 12, comprises a first horizontal portion **132*a*, a first upthrow portion 132*b*, a second horizontal portion 132*c*, a second upthrow portion 132*d*, a third horizontal portion 132*e*, a first drawdown portion 132*f*, a second drawdown portion 132*g* and a fourth horizontal portion 132*h*. Said track also comprises a lower upthrow portion 132*i***.

In turn, the second track 134 comprises an uninterrupted lower horizontal portion **134*a* and the following upper portions: a first upthrow portion 134*b*, a second horizontal portion 134*c*, a first drawdown portion 134*d*, a second upthrow portion 134*e*, a third horizontal portion 134*f*, a second drawdown portion 134*g*, a fourth horizontal portion 134*h*, a third drawdown portion 134*i*, a fifth horizontal portion 134*j* and a third upthrow portion 134*k*. The moving stitch cam, in turn is provided with operative drawdown portions 140*a* and 140*b***.

Figure 14:
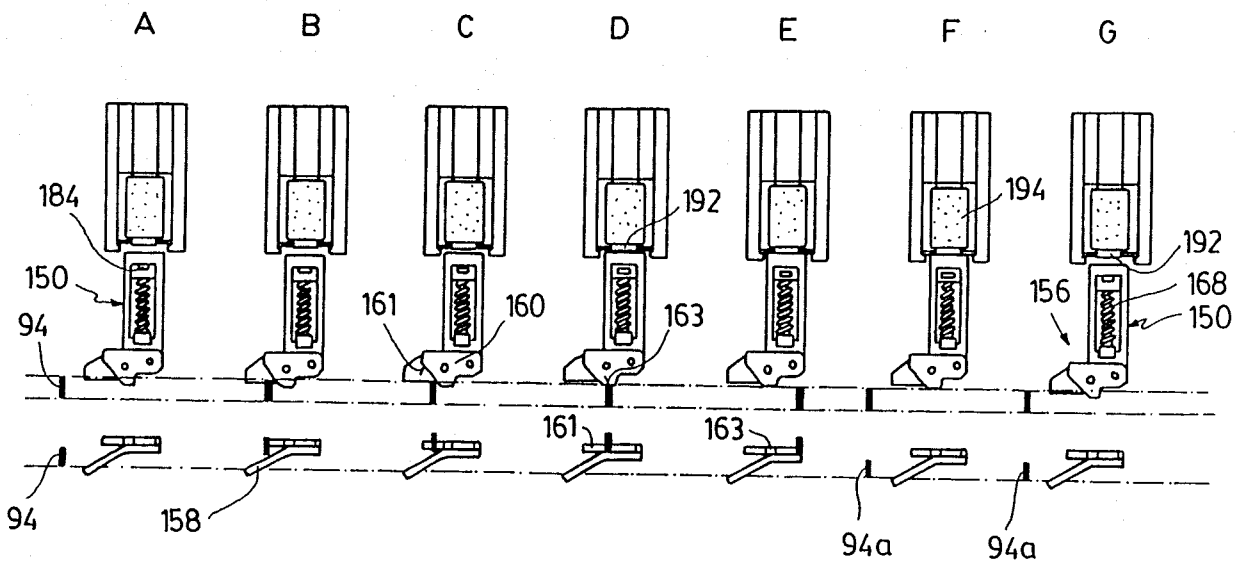
FIG. 14 is a diagram showing the successive positions (A-G) of a selector and a selector jack selector butt, both in plan view and in elevation.
Figure 15:
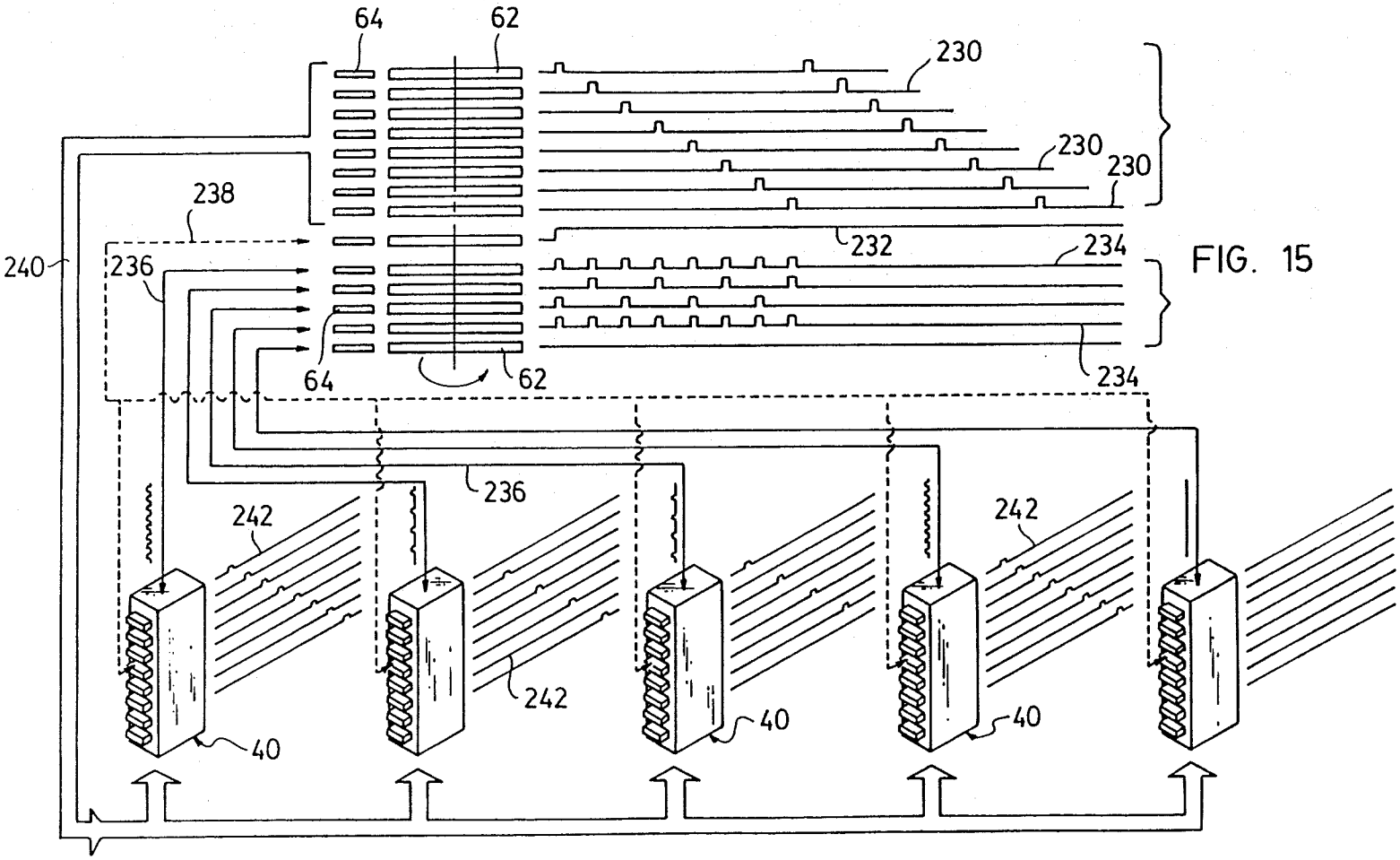
FIG. 15 is a schematic view of the timing, voltage and control signals arriving at each multilevel electronic jacquard control over a limited number of lines through brushes and selectors.

During one cycle, the selection system works as follows:

The alignment cam 148 engages the vertical alignment butt 92 of the selector jack 80, thereby cancelling out any possible vertical movements of the jack caused during the previous selection and the selector butt is placed in the operative position relative to the selectors 150, i.e. the butt 94 is at the level corresponding thereto out of the plurality of preset levels above mentioned. In turn, the cancellation cam 142 engages the rocking cancellation butt 96 of the jack 80, whereby the latter may rock about its rocking area and is retained, by the cancellation cam 142 itself, in the farthest removed position from the cylinder and therefore closest to the selectors 150. In these conditions, the selector butt 94 of the jack 80 is in position A of FIG. 14, in which the selector 150 is seen to be in the extended position, abutting the vertical key 184.

As the selectors continue to rotate (position B), butt 94 engages the upper surface of the downwardly sloping portion 158 of the selector 150, whereby the jack 80 is moved vertically upwards, which movement continues in position C in which the butt 94 starts to engage the operative surface 161 of the prismatic cam 160 of head 156 of selector 150. This starts, in turn, retraction of the selector 150. When the upward movement of the butt 94 of jack 80 terminates (position D), said butt is opposite the front surface 163 of the prismatic cam 160 and, therefore, the selector 150 reaches its innermost retracted position, contacting the central pole extension 192 and being retained in this position by the electromagnetic field.

Without varying the situation of the selector 150, the butt 94 moves away and the jack 80 is ready to be selected (position E), the rocking cancellation butt 96 having disengaged the cancellation cam 142, whereby the jack may be rocked towards the cylinder 8 by engagement of the sloping surface 136 with the upper shoulder 102.

Unless current is applied to the electromagnet or coil 194, the selector 150 remains retained (position F), and the butt 94*a* of the following jack 80 does not engage the head 156 of the selector 150, whereby the following jack is not raised and therefore does not rock towards the cylinder either, which situation is expressed hereinafter in the sense that the jack has not been selected. On the contrary (position G), if current is applied to the electromagnet or coil 194, the retaining electromagnetic field is destroyed. The selector 150 extends outwardly, moving away from the pole extension 192 urged by the compression spring 168, whereby the selector is in a position to engage the butt 94*a*, causing the following jack 80 to be selected.

If no selectin takes place, the selector 150 remains retained by the coil 194. Thus, the following selector jack 80 is not raised vertically, whereby the rocking cancellation butt 96 remains at the lower level L1 (FIG. 13), while the upper shoulder 102 remains at level L3 and, therefore, outside the reach of the sloping surface 136. The butt 108 of the intermediate jack 104 enters in the first main track 132 while the butt 116 of the slider 114 enters in the second main track 134. If the second selector does select (as stated above, each operative set comprises two multilevel electronic jacquard controls 40), the intermediate jack 104 rocks and the butt 108 follows path 204 (FIG. 10), since it avoids the second upthrow portion 132*d* and the butt 116 follows path 206, whereby the needle 122 is in the operative fabric face knitting position. The slider 114 does not rock towards the cylinder and, therefore, the butt 116 thereof continues to engage the various upper postions of the track 134.

Figure 12:
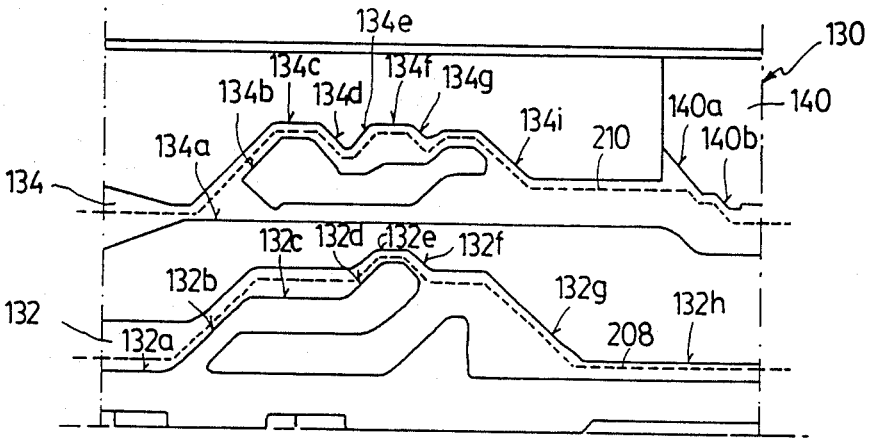

On the contrary, if there is no selection by the second selector, the butts 108 and 116 respectively follow paths 208 and 210 of FIG. 12, in other words, the butt 108 succesively engages portions 132*b*, 132*d*, 132*f* and 132*g*, and the needle 122, attached to the slider 114, firstly follows an upward path, conventionally called a transfer path to the upper cylinder, all due to the action of the butt 116 of the slider 114 on the portions 134*b*, 134*c*, 134*d*, 134*e*, 134*f* and 134*g*, and secondly a downward path because of portions 134*i*, 140*a* and 140*b*. The needle, thereby, is moved to the position of needle transfer from the lower to the upper cylinder.

If there is selection in the first selection, the selector 150 moves away from the coil 194. Therefore, the following selector jack 80 is moved vertically upwards, whereby the rocking cancellation butt 96 moves to level L2 (FIG. 13) while the upper shoulder 102 moves in turn to level L4. Thereby, the sloping surface 136 of operative cam 130 engages the upper shoulder 102 of the selector jack 80, whereby the latter rocks. Thus, there is selection and butt 108 of the intermediate jack 104 does not enter the main cam track 132, whereby the intermediate jack is not raised and consequently the slider 114 is not raised either, whereby although the butt 116 thereof enters in the main cam track 134, it remains on the lower uninterrupted horizontal portion 134*a*, without engaging the first upthrow portion 134*b*.

Figure 9:
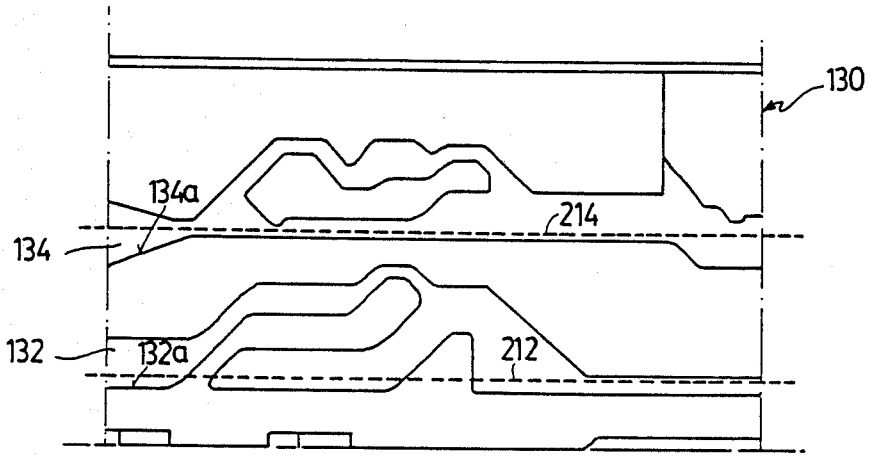
FIGS. 9 to 12 are each a diagram corresponding to each possible path of the jack butts relative to the cams.
Figure 10:
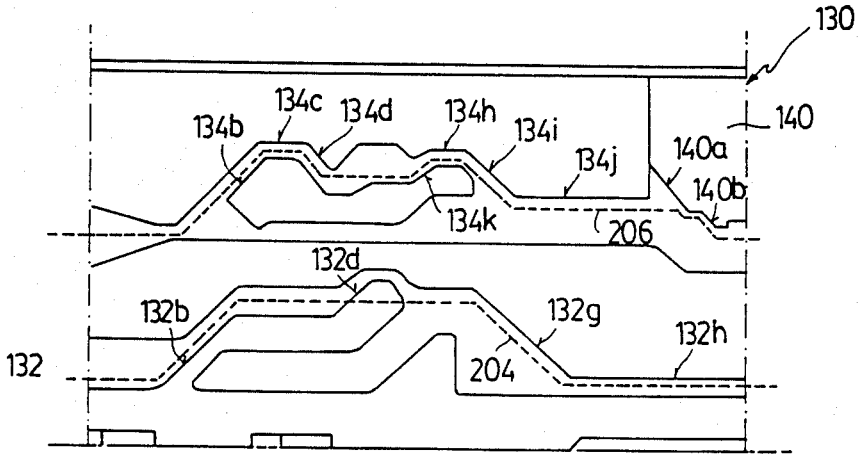

If there is selection by the second selector, there is no subsequent raising of the jack 104 and slider 114 either, whereby the respective butts 108 and 116 thereof follow paths 212 and 214 of FIG. 9, the needle remaining in the cancellation position, that is the inactive position.

Figure 3:
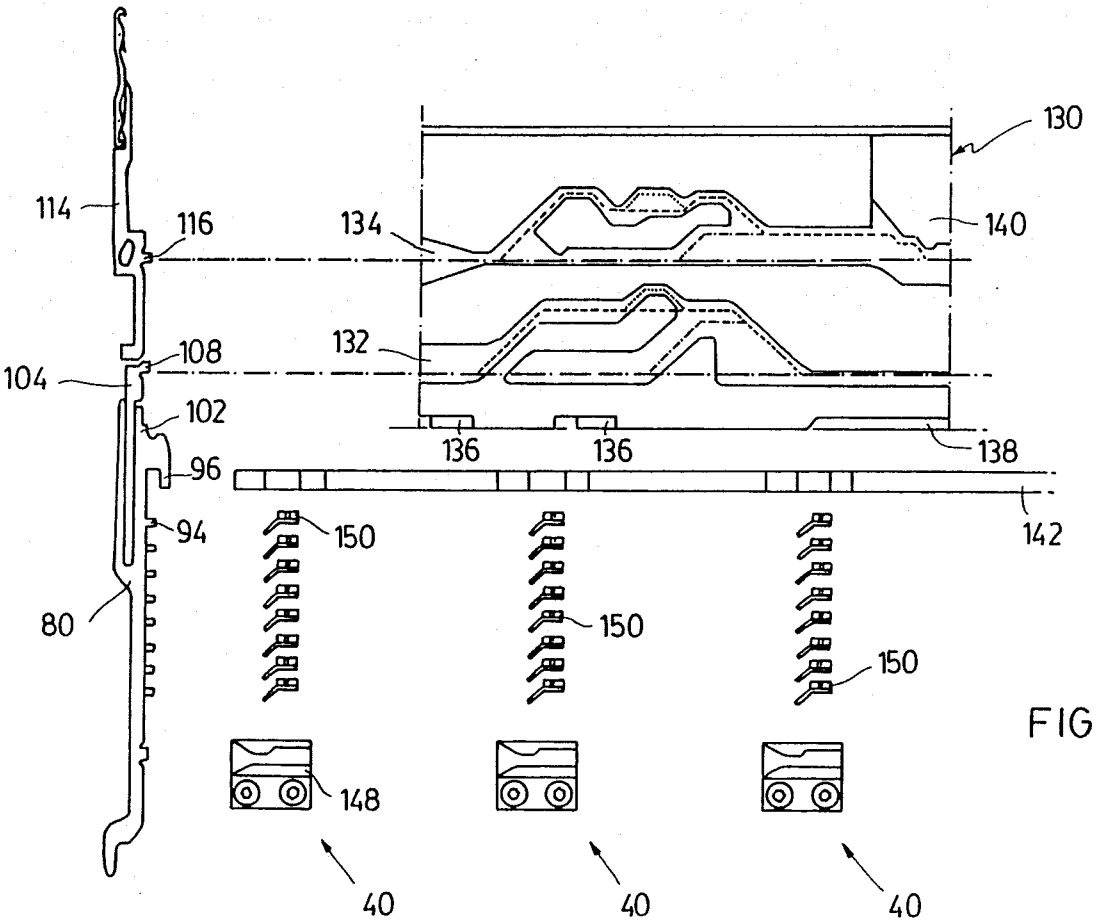
FIG. 3 is a schematic view showing the association of a set of jacks of the selection system with the corresponding cams, the variety of possible jack butt paths being shown in phantom lines.
Figure 11:
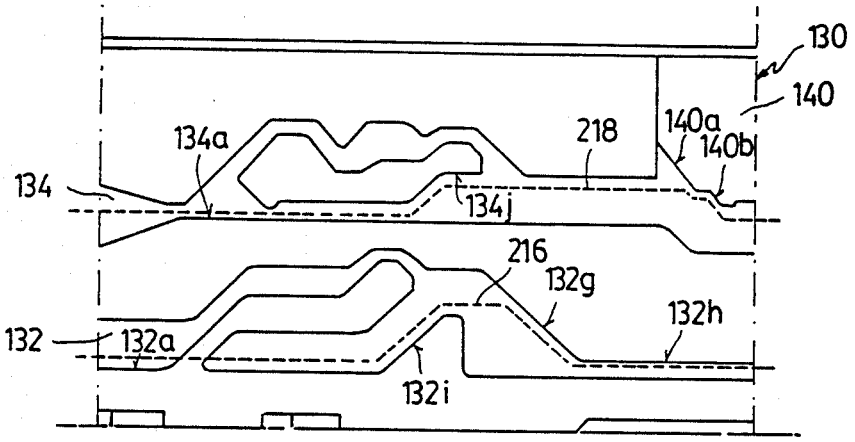
Figure 13:
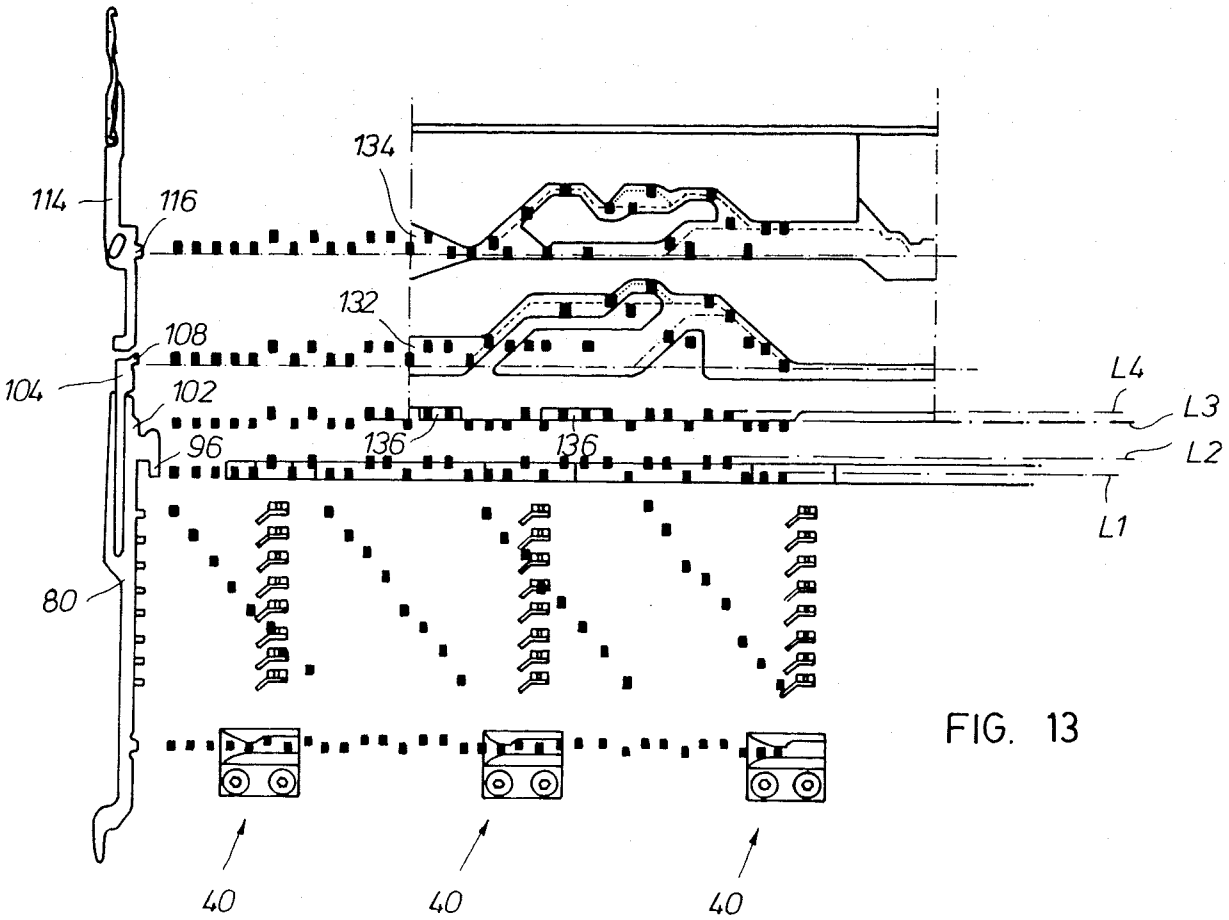
FIG. 13 is a diagram similar to that of FIG. 3 showing by way of blacked out rectangles successive positions of the jack and slider butts.

On the contrary, if there is no selection by the second selector, the butts 108 and 116 respectively follow paths 216 and 218 of FIG. 11 (since butt 108 engages inner upthrow portion 132*i*), moving the needle to the tuck position. In FIGS. 3 and 13 the paths 204 to 218 appear superimposed, although drawn with different types of line.

The position of pick-up of needle transfer from the upper cylinder to the lower cylinder is reached whenever there is no selection at the first selection.

As stated above, in the so-called sweater type circular knitting machine, the needle cylinder 8 is static and the cam sections 44 and the columns of electronic jacquard selection controls 40 are moving.

In machines of the above described type having electronic jacquard selection, this is a further drawback, since the control orders from the electronic controller have to reach the moving portion where the selection columns or controls 40 are located.

This drawback may be overcome in several ways. In one of them, the electronic controller is static, i.e., it does not rotate (like the controller 52) and the data and orders are transmitted to the multilevel electronic jacquard controls or columns 40 by way of brushes.

This way (which is the most usual one) provides the advantage of having the controller always accessible for programming, maintenance and repair and, furthermore, it protects the controller from vibrations.

The negative aspects are the need to have al arge number of lines extending from the controller to the multilevel electronic jacquard controls through the brushes, with the drawback that the lines have to pass through the inner and outer locking rings (14 and 16 in the embodiment described), which weakens the structure and this weakening increases with the number of lines, since the space to let them through must be larger.

To appreciate the seriousness of this drawback, it should be pointed out (just as a guidance) that the so-called sweater machines are usually provided with 18 operative sets and that there are on average 8 selection levels on the jacquard selection control or column associated with each set. Thus the number of electromagnets (or elecromagnetic coils) to be controlled is $8 \times 18 = 144$, meaning that the required number of brushes is 144. In the case of double selection, this number is duplicated ($144 \times 2 = 288$) and if, furthermore, the machine has selection on the disc, the number of brushes is triplicated ($144 \times = 432$).

Another way of overcoming the abovementioned drawback is to provide the electronic controller on the moving part of the machine, as well as the jacquard selection controls or columns. This avoids the majority of the brushes, but not the lines, because the latter still have to connect the electromagnets (or electromagnetic coils) to the controller.

The drawbacks of this alternative way are, on the one hand, that the degree of electronic reliability is affected to the extent that vibrations are readily a source of failures and faulty contacts and, on the other hand, since the controllers are located on a moving portion, access thereto for programming, repair and maintenance is hindered, it being possible to perform such operations only with the machine stopped.

With the embodiment of the invention, it is possible to have the advantages of both ways described simultaneously.

On the one hand, the electronic controller 52, with all its main parts, is located on the static portion. A single line 236, related with the controller, extends from the brushes 64 towards each electronic control 40 (one line for each electromagnetic coil 194 is not required), plus one single line 238 for the voltage (common to all controls), plus one line for each timing signal, corresponding to each of the jacquard selection levels, said lines being united in a single group called timing bus 240, comprising eight lines in the embodiment shown.

It is this small number of lines that has to reach the controls 40 through the brushes 64 and slip rings 62. Since the number is small, it does not weaken the structure, and since the lines easily pass through the gap conventionally existing between the inner and outer locking rings, room is left for the passage of the yarns being knitted in the machine.

On reaching the jacquard selection controls or columns 40, the control signals 234 transmitted in series along a single line 236 per column 40, are reprocessed, recycled and redistributed into parallel signals 242 for as many channels as there are electromagnetic coils on each column, all depending on the timing signal 230 corresponding to the jacquard selection level to be activated at that time.

The series signals 234 may be reporcessed, recycled and redistributed into parallel signals 242 in a small, simple elementary electronic circuit, because the selection system according to the invention operates with signals having a duration shorter than the time elapsing (at the maximum operating speed) between the passage of two contiguous needles before one same rotating member and also because the speed of response of the selectors 150 is very rapid, in view of the above described features of the electronic and electromagnetic unit 152. As a result, the series signals 230 do not superimpose themselves and may be redistributed without interference by the various parallel output channels corresponding to the different levels existing on each jacquard selection control or column 40.

It should also be pointed out that the controller processes the control signals thereof depending on the fabric to be knitted and the number of operative sets, fully independently of the number of jacquard selection levels contained in each control 40, since the distribution by levels is carried out at the control itself, depending on the number of timing signals.

This arrangement allows the number of selection levels to be adapted to the particular speed needs of each machine and each pitch, depending on the spaces available per pitch, without the need to introduce changes in the controller.

What I claim is:

1. A needle selection system for a cicular knitting machines, comprising:

(a) non-rotating members including, for each needle:
- a selector jack capable of rocking movement and of vertical movement and having an alignment butt, a selector butt and a rocking cancellation butt;
- an intermdiate jack having a butt, being capable of rocking integrally with the selector jack and being capable of vertical movement independent of the vertical movement of the selector jack; and
- a slider also having a butt and being associated with the needle but not associated with the rocking movement of the jacks, while being capable of accompanying the intermdiate jack in the upward movement thereof; and (b) rotary members including, in turn:
- operative cams;
- rocking cancellation cams;
- electronic multilevel jacquard controls, each of which includes: an alignment cam, and a plurality of selectors located at different levels, each of which selectors is capable of occupying a retracted position in which it does not engage a selector butt and an extended position in which there is mutual engagment between a selector and a selector butt, the corresponding selector jack being caused to rise and the selector being moved to said retracted position;
- wherein, in association with each of said operative cams, there is a first means which is complementary to second means disposed in said selector jack, such that when one selector jack is caused to rise, said first and second means mutually engage and cause selection of the selector jack by rocking it; and
- wherein one operative cam includes a first main track adapted to receive the butt of the intermediate jack and a second main track along which there moves the butt of the slider, said second track being provided with an uninterrupted lower horizontal portion over which said slider butt travels when the slider has not been previously raised by a vertical upward movement of the intermediate jack, there being two electronic controls for each operative cam, such that each selector jack is capable of not being selected or of being selected one or two times during its successive passage in front of said first means associated with one same operative cam.

2. The system of claim 1, wherein said first means comprises two successive lower sloping surfaces of the operative cam and said second means includes an upper shoulder of the selector jack.

3. The system of claim 1, wherein if, while passing in front of said first means associated with one same operative cam, the selector jack is selected twice, the needle remains in an inoperative position.

4. The system of claim 1, wherein if, while passing in front of said first means associated with one same operative cam, the selector jack is selected the first time and is not selected the second time, the needle is raised to a tuck position.

5. The system of claim 1, wherein if, while passing in front of said first means associated with one same operative cam, the selector jack is not selected the first time and is selected the second time, the needle is raised to an operative fabric face knit position.

6. The system of claim 1, wherein if, while passing in front of said first means associated with one same operative cam, the selector jack is not selected at all, the needle is raised to a position of transfer from a lower cylinder of the system to an upper cylinder.

7. The system of claim 1, wherein a needle transfer pick-up position from an upper cylinder of the system to a lower cylinder is reached every time the selector jack is not selected at the first selection.

8. The system of claim 1, wherein each electronic multilevel jacquard control comprises:

a box in which there is housed generally horizontally said plurality of selectors which may slide between a retracted position and an extended position and in which each selector includes a sheet-like member having: a head; a rear end; a slot; means housed therein for urging the selector to said extended position; means for constraining said sliding movement to said extended position, wherein said head comprises: a downwardly directed portion having on the upper side thereof a surface generally having the form of a sloping surface adapted to engage the selector jack butt, thereby causing it to rise; and a prismatic cam having a generally flat vertical operative surface, adapted to be engaged by the butt of the upwardly raised selector jack, said engagement causing the selector to move from said extended position to said retracted position.

9. The system of claim 8, wherein said means for constraining said sliding movement to said extended position comprises a vertical key member crossing through a rear portion of the slot of each selector.

10. The system of claim 8, further comprising:

each box being associated with an electronic and electromagnetic unit adapted selectively to retain the selectors in the retracted position thereof, wherein each unit includes: a single central core having central pole extensions, each of the latter being opposite the rear end of a selector; an electromagnetic coil surrounding each central pole extension; a pair of flat ceramic permanent magnets, situated one on each side of the central core and in contact therewith; a pair of lateral pole extensions, each one contacting one of the permanent magnets on the opposite side thereof relative to the central core, said lateral pole extensions being closer to the box than the central pole extensions with a gap therebetween being greater than a width of the rear end of the selector, such that when the selector is in the retracted position, said rear end engages the corresponding central pole extension, between the said lateral pole extensions, and an air gap is formed between each lateral extension and the selector.

* * * * *